United States Patent [19]

Basso

[11] Patent Number: 4,771,186

[45] Date of Patent: Sep. 13, 1988

[54] LIGHT-SENSITIVE SWITCH STRUCTURE AND METHOD WITH INVERSE OFF/ON RATIO

[76] Inventor: Egidio Basso, 9145 Dallas, Grosse Ile, Mich. 48138

[21] Appl. No.: 828,370

[22] Filed: Feb. 11, 1986

[51] Int. Cl.[4] ..... H01H 35/00; H01H 47/24; H01J 40/14

[52] U.S. Cl. ..... 307/117; 250/206; 250/214 AL; 361/175

[58] Field of Search ..... 307/117; 250/206, 209, 250/214 AL; 361/174–177

[56] References Cited

U.S. PATENT DOCUMENTS

| | | | |
|---|---|---|---|
| 3,351,762 | 11/1967 | Adkins et al. | 250/206 |
| 3,529,214 | 9/1970 | Corn | 307/117 |
| 3,629,649 | 12/1971 | Del Zotto | 361/175 |
| 3,636,357 | 1/1972 | Del Zotto | 361/175 |
| 3,916,183 | 10/1975 | Duve et al. | 250/114 AL |
| 4,095,100 | 6/1978 | Selick | 250/206 |

OTHER PUBLICATIONS

Radio and Electronics Constructor, June 1980, pp. 604–608.

*Primary Examiner*—Vit W. Miska

*Attorney, Agent, or Firm*—Dale R. Small & Associates

[57] ABSTRACT

Light-sensitive switch structure for and method of turning a street light, or other load, on or off in response to varying light levels. The switch is designed to recognize the daily variations in light level and is capable of switching a load off at a light level lower than that at which the load is switched on. In a preferred embodiment the switch consists of a photo-sensitive element, two relays with time delay features, and two current limiting resistors to regulate the current flowing through the operating coils of the relays. In other embodiments wherein the values of the circuit components are properly selected one of the resistors regulating the current flowing through the operating coils of the relays may be eliminated. In accordance with the method of the invention one of the relays operates contacts which energize or de-energize the load, while the other relay operates contacts which connect or disconnect the resistors to or from the operating coils of the relays. The resistors function in concert with the varying resistance of the photo-sensitive element to provide the desired operation of the relays to effect the desired energizing of the load with an inverse light level ratio.

19 Claims, 3 Drawing Sheets

LIGHT-SENSITIVE SWITCH STRUCTURE AND METHOD WITH INVERSE OFF/ON RATIO

BACKGROUND OF THE INVENTION

1. Field of the Invention

The present invention relates to condition-sensitive switching structures and methods and refers more specifically to a light-sensitive electrical switch and method useful for controlling street lamps or decorative and/or safety lighting so that they are energized during the hours of darkness.

2. Description of the Prior Art

The structures commonly used at the present time for controlling street lights include photo-sensitive elements. These structures are simple, inexpensive, and operate automatically and reliably for a number of years. They generally consist of a photo-sensitive element the resistance of which varies inversely as the light striking it, a time delay relay with normally closed contacts to control the load, and occasionally, some resistors to control the current through the operating coil of the relay. The time delay feature is needed to prevent the control from responding to transient changes in light level such as may be caused by lightning flashes or automobile headlights. The normally closed contacts provide "fail-on" operation of the street lights in response to the most likely failure modes of the control.

Adjustment of the turn-on light level in accordance with prior methods for controlling street lights is made by adjusting the drop-out current through the relay. This may be accomplished by controlling the light which strikes the photo-sensitive element, limiting the relay current with resistors, and/or mechanically adjusting the force required to operate the relay contacts. Once the turn-on light level has been selected, the turn-off light level is automatically fixed also. And, since the relay's pull-in current is always higher than the drop-out current, the turn-off light level will always be higher than the turn-on light level. This turn-off light level to turn-on light level ratio, typically, varies anywhere from 2:1 to 5:1.

For a number of reasons, it is desirable to turn on street lights in the evening earlier than when they are actually needed. These reasons have to do with the physiological effects that the waning evening light has on the human eye and also with the fact that some of the street lights, presently in use, require a period of warm-up time before they reach full brilliance. However, this means that the lights are turned off in the morning at a light level which is from two to five times higher than the turn-on level in the evening. In fact, it is satisfactory to turn the lights off in the morning at a light level which may be three or four times less than the turn-on light level in the evening. Thus, a light-sensitive switch with a turn-off to turn-on ratio of less than 1:1 would be desirable. Ratios of 1:3 or 1:4 would be ideal. Such a control would promptly turn off the lighting load when it was no longer needed, thereby saving substantial amounts of energy.

The prior art discloses efforts to address this problem by designing light-sensitive switches with off-on ratios as close to 1:1 as possible (see U.S. Pat. No. 3,351,762 and U.S. Pat. No. 4,095,100 for a description of some of these efforts). The difficulty with these controls is that their operation is likely to become unstable. When the light level is near the operating point in the evening or in the morning, slight variations in light intensities, such as may be caused by clouds, may cause the control to cycle on and off. This mode of operation is disturbing to the viewer and may also cause damage to some of the lights presently in use. No efforts to devise a control with an inverse turn-off to turn-on ratio (that is a control wherein the turn-off light level is lower than the turn-on light level) are disclosed in the known prior art.

SUMMARY OF THE INVENTION

The present invention is a light-sensitive switch for and method of turning a load, such as a street lamp, on or off in response to a varying condition such as light level. The structure and method of the invention provide for automatically turning the load off in the morning at a light level which is lower than the light level at which the load was turned on in the evening, thus providing an inverse turn-off to turn-on ratio. Such operation is accomplished in accordance with the method of the invention by using an auxiliary relay to increase, during the hours of darkness, the current through a relay which controls the load. The stability of the control is assured by providing a biasing current upon reaching a light level which is lower than the turn-off light level in the morning. Furthermore, the amount of biasing current supplied will cause the total current through the load control relay to be close, but not equal, to the load control relay pull-in value. The load control relay pull-in value will only be reached when the current is increased in response to the increasing light level in the morning.

DESCRIPTION OF THE PREFERRED EMBODIMENT

Figure 1:
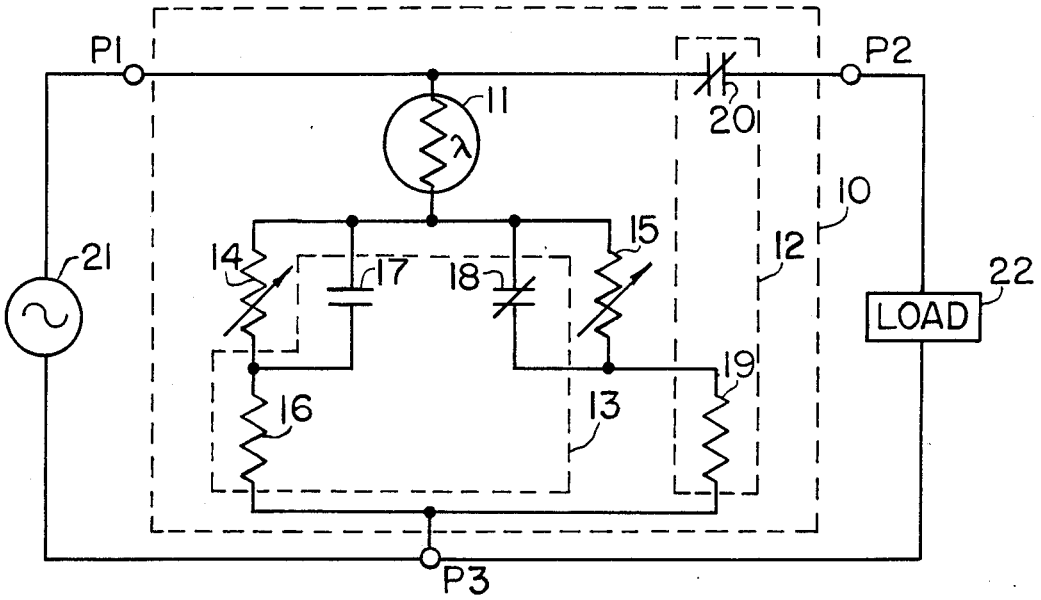
FIG. 1 is schematic diagram of light-sensitive switch structure constructed in accordance with the invention for practicing the method of the invention shown connected to a source of alternating current electrical energy and to a load.
Figure 2:
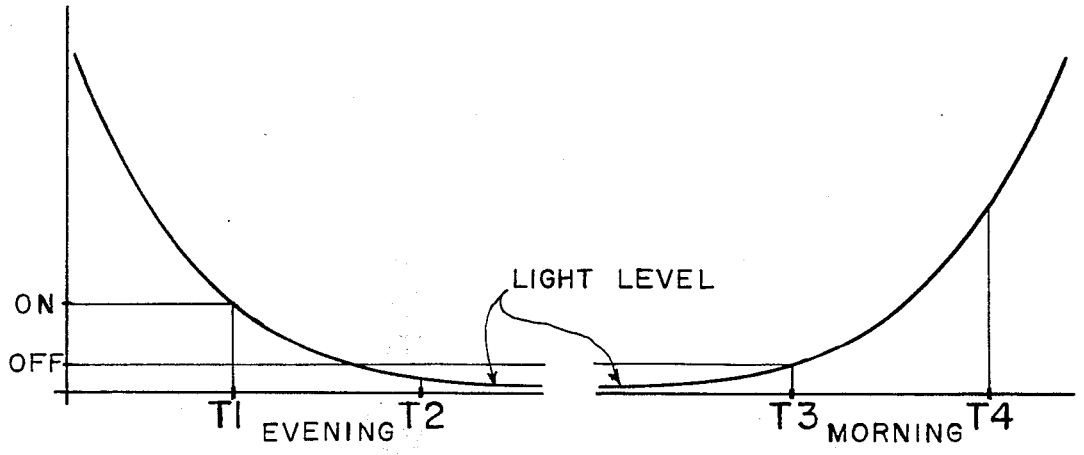
FIGS. 2 through 8 are graphs useful in explaining the operation of the circuit of FIG. 1 in accordance with the method of the invention and showing, as a function of time, the evening and morning variations in light level, the corresponding variations in the resistance of the photo-sensitive element of the circuit shown in FIG. 1, the current through the operating coil of the load control relay shown in FIG. 1 and the status (opened or closed) of its normally closed contacts, the current through the operating coil of the auxiliary relay shown in FIG. 1 and the status of the normally open and normally closed contacts of the auxiliary relay respectively.

The preferred embodiment of the present invention is a light-sensitive switch 10 including a photo-sensitive element 11, whose resistance varies in inverse proportion to the light striking it, a load control relay 12, an auxiliary relay 13, and two current limiting resistors 14 and 15.

The load control relay 12 and the auxiliary relay 13 are both time-delay thermostatic switches each having a bi-metallic actuating arm in thermal contact with their respective heating coils 19 and 16. The load control relay 12 also has a set of normally closed contacts 20, while the auxiliary relay 13 has a set of normally open contacts 17 and a set of normally closed contacts 18.

The components of the switch 10 are intended to be assembled and mounted in a plug unit which is known in the prior art and is not illustrated here (see U.S. Pat. No. 3,048,833). This plug unit is equipped with three contacts or prongs protruding through the base and designed to mate with a corresponding socket on the street light fixture. These prongs are identified as P1, P2, and P3 in the schematic diagram of FIG. 1 and are used for connecting the switch 10 to the alternating current (AC) electrical energy source 21 and to the load 22. Spark gaps may also be added to provide protection against lightning and other line surges.

As illustrated in FIG. 1, the photo-sensitive element 11 is connected on one side to the prong or terminal P1 which, when the switch 10 is plugged into its mating socket, will connect the switch 10 to the line side of the AC energy source 21. On the other side the photo-sensitive element 11 is connected to one side of two parallel branch circuits.

The first of the parallel branch circuits consists of current limiting resistor 14 connected in series with the heating coil 16 of the auxiliary relay 13. The second of the parallel branch circuits consists of another current limiting resistor 15 connected in series with the heating coil 19 of the load control relay 12.

The other side of each of the two parallel branch circuits is, in turn, connected to prong P3. Thus when the switch 10 is plugged into the mating socket, the connection of the photo-sensitive element and parallel branch circuits to the AC energy source 21 is completed.

The normally open contacts 17 of the auxiliary relay 13 are connected in parallel with current limiting resistor 14. Thus the resistor 14 will be short-circuited when the auxiliary relay 13 is energized.

The normally closed contacts 18 of the auxiliary relay 13 are connected in parallel with current limiting resistor 15. Therefore resistor 15 will be short-circuited when the auxiliary relay 13 is de-energized.

The normally closed contacts 20 of the load control relay 12 are connected between prongs P1 and P2 of the switch 10. When the switch 10 is plugged into the mating socket, the prongs P1 and P2 will connect the load 22 to the AC energy source 21 provided the contacts 20 are closed which, in turn, will occur when the load control relay 12 is de-energized.

The graphs of FIGS. 2 through 8 in conjunction with the schematic diagram of FIG. 1, will be used to describe the daily sequence of operation of the light-sensitive switch 10 in accordance with the method of the invention.

During the daylight hours, when the light level is high, the resistance of the photo-sensitive element 11 is at its minimum. Therefore, the currents through the operating coils 16 and 19 of the auxiliary relay 13 and the load control relay 12 respectively are higher than the pull-in value and relays 13 and 12 are energized. At this time current limiting resistor 14 is short-circuited while current limiting resistor 15 is in the circuit in series with heating coil 19 of load control relay 12. Also, normally closed contacts 20 are in the open position and the load 22 is de-energized.

Figure 3:
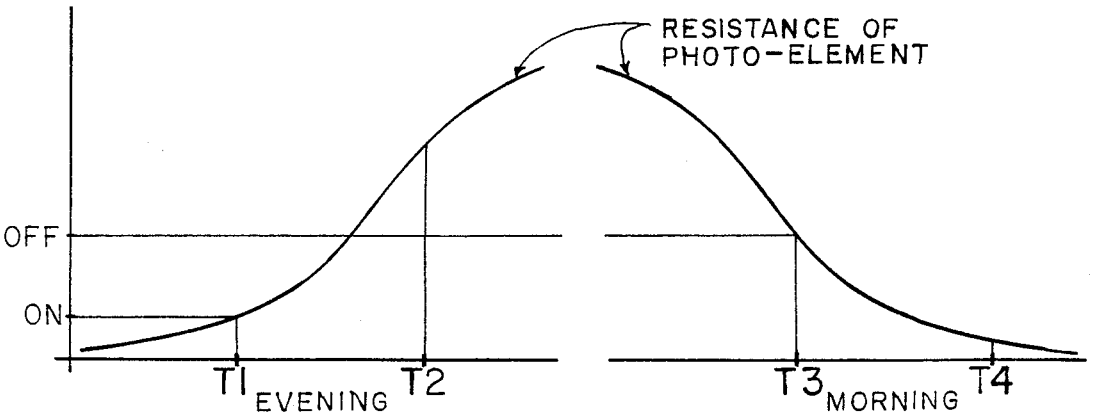
Figure 4:
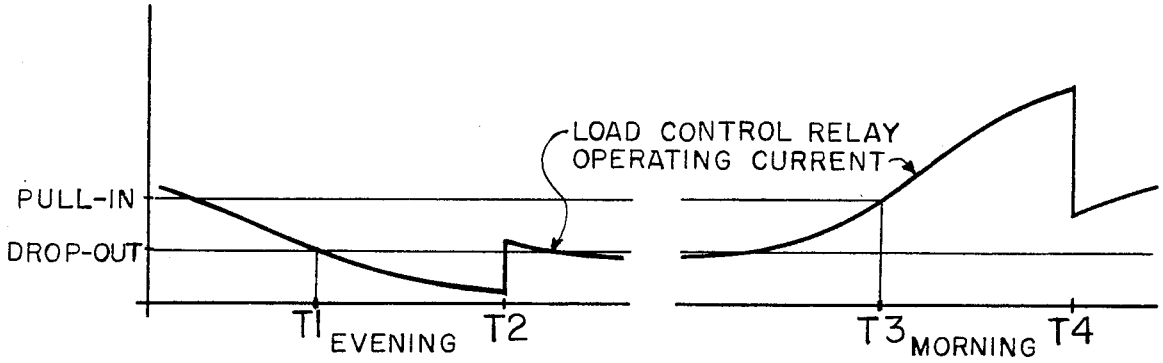
Figure 5:
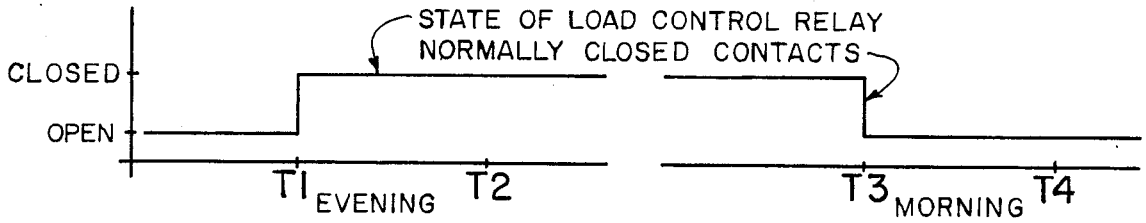
Figure 7:
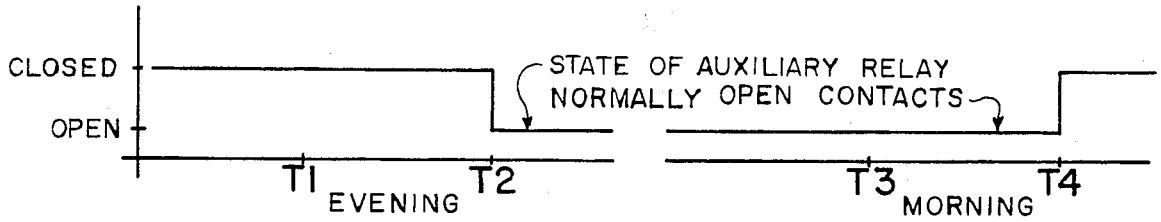
Figure 8:
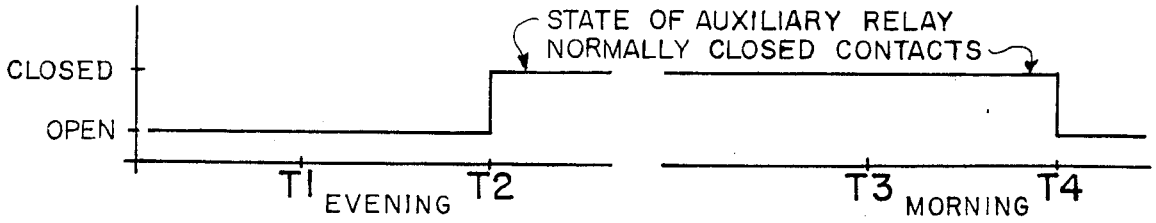

As the light drops to a predetermined level in the evening, the increase in the resistance of the photo-sensitive element 11 will cause the load control relay 12 to drop-out as shown in FIG. 4, contacts 20 to close as shown in FIG. 5, and the load 22 to be energized. These events are indicated at time T1 in FIGS. 3, 4 and 5. Auxiliary relay 13 has not yet dropped out as shown in FIGS. 7 and 8 because its operating current is still above the drop-out level, as shown in FIG. 6 owing to the fact that its current limiting resistor 14 is short-circuited.

Figure 6:
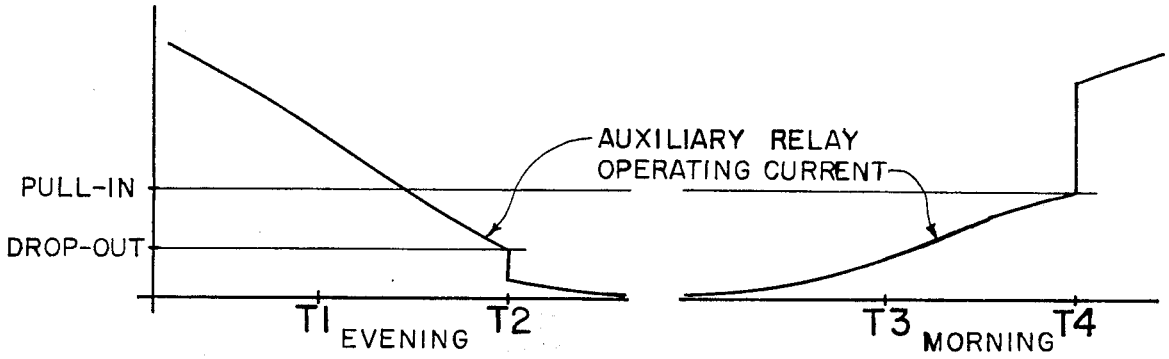

As the light level declines further in the evening, the resistance of the photo-sensitive element 11 will continue to increase as shown in FIG. 3, and the operating currents through the relays 12 and 13 will continue to decrease as shown in FIGS. 4 and 6, respectively. Eventually the drop-out current will be reached for auxiliary relay 13 also. This event is indicated at time T2 in FIGS. 2, 3, 4, 6, 7 and 8.

When auxiliary relay 13 drops-out, contacts 17 will open and contacts 18 will close. This will insert current limiting resistor 14 in series with the operating coil 16 of the auxiliary relay 13, thus further reducing its operating current as shown in FIG. 6. It will also short-circuit current limiting resistor 15 which is in series with the operating coil 19 of the load control relay 12, thus increasing its operating current as shown in FIG. 4.

The values of the components in circuit 10 must be chosen so that the operating current of the load control relay 12 is baised towards, but is not permitted to reach, the pull-in value of the load control relay at this time T2 as shown in FIG. 4. This will permit the load control relay 12 to remain de-energized thus keeping the load 22 energized through the hours of darkness.

As the light level begins to increase in the morning, the resistance of the photo-sensitive element 11 will decrease, and the operating currents through both relays 12 and 13 will increase as shown in FIGS. 4 and 6, respectively. The load control relay 12, whose operating current is not being limited by current limiting resistor 15 at this time will reach the pull-in value first, causing it to open contacts 20 and de-energize the load 22. This event is indicated at time T3 in FIGS. 2, 3, 4 and 5.

Although the pull-in current for both the auxiliary relay 13 and load control relay 12 is two to five times higher than their respective drop-out currents, the biasing effect on the load control relay 12 brought about by auxiliary relay 13, and described above, will permit the load 22 to be switched off at a light level lower than that at which the load 22 was switched on the evening before.

As the light level increases further, the operating current through the auxiliary relay 13 will reach the pull-in value. This event is indicated at time T4 in FIGS. 2, 3, 6, 7 and 8. Current limiting resistor 14 will be short-circuited by the closing of contacts 17, causing the operating current through auxiliary relay 13 to increase as shown in FIG. 6. Current limiting resistor 15 will be re-inserted in series with the operating coil 19 of load control relay 12 by the opening of contacts 18 as shown in FIG. 8. This will cause the operating current through load control relay 12 to decrease as shown in FIG. 4. However, the component values in circuit 10 are such that this current will not reach the drop-out value of load control relay 12 as shown in FIG. 4 so as not to re-energize the load 22.

The components have now completed their daily cycle of operation in accordance with the method of the invention and are now set to repeat it again the following evening.

As indicated above it is recognized that for proper operation of the switch 10, it is necessary to coordinate the selection of the various component values and operating characteristics with each other. These values however are either readily available commercially or can be incorporated into the design and manufacture of the components easily within the skill of the art. Furthermore, some of the operating characteristics or component values, such as the values of the current limiting resistors 14 and 15, may be made variable, as shown in FIG. 1, so the user of the device can select the operating characteristics of the switch 10 to meet specific requirements.

While a preferred embodiment of the structure and method of the invention has been considered in detail above, it will be understood that other embodiments and modifications of the invention are contemplated.

Figure 9:
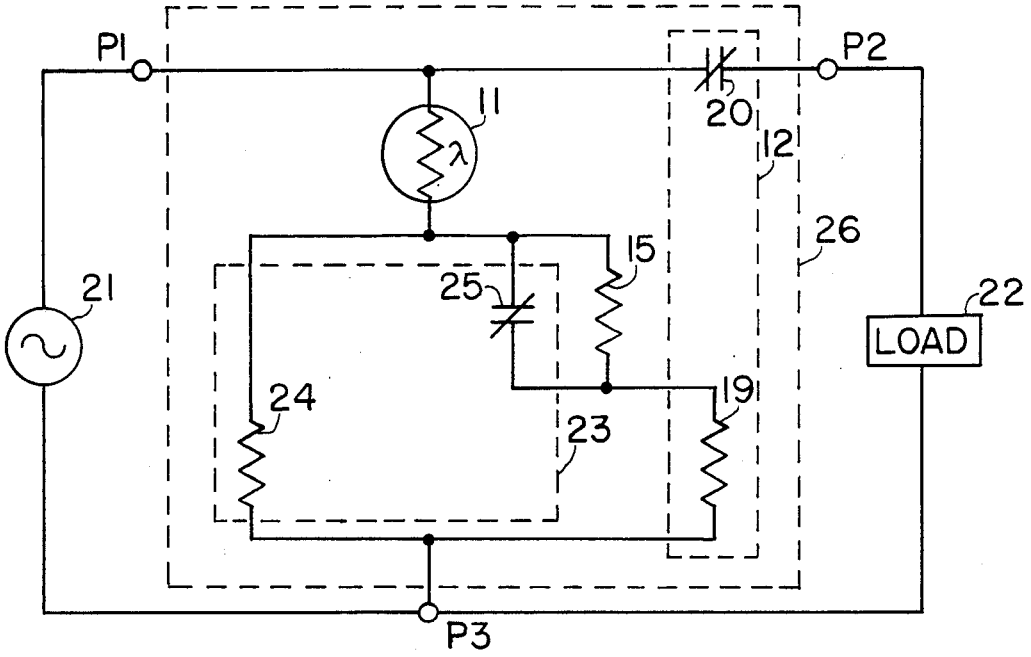
FIG. 9 is a schematic diagram of a second embodiment of the invention.
Figure 10:
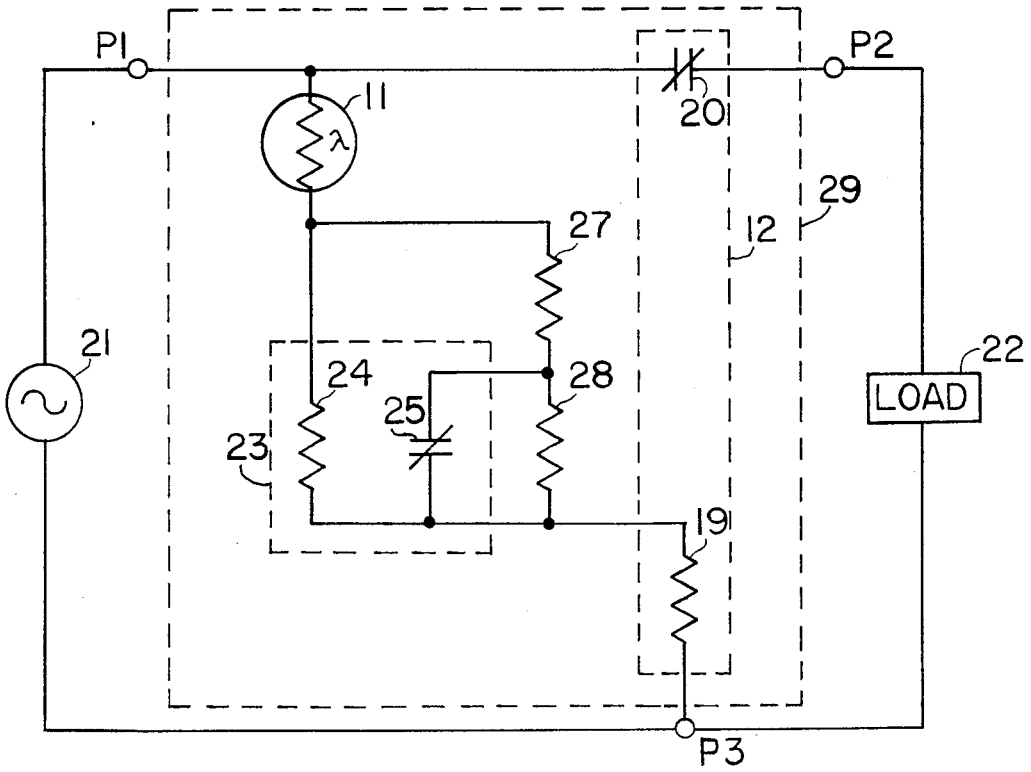
FIG. 10 is a schematic diagram of a third embodiment of the invention.

FIGS. 9 and 10 show two additional embodiments of the invention generally intended to simplify the circuit of FIG. 1 and some of the components described therein.

FIG. 9 depicts, schematically a light-sensitive switch 26 wherein the auxiliary relay 23 has been simplified to have only a set of normally closed contacts 25 in addition to its operating coil 24. The current limiting resistor 14 and normally open contacts 17 of FIG. 1 have been eliminated. This is made possible by designing the auxiliary relay 23 with operating characteristics that will cause it to drop out at T2 and pull in at T4, as shown in FIG. 6, without biasing its own operating current.

FIG. 10 depicts schematically another light sensitive switch 29 which utilizes the simplified auxiliary relay 23 described above but without the stringent requirements placed on the design of its operating characteristics. This is accomplished by using current limiting resistors 27 and 28 in conjunction with the normally closed contacts 25 of auxiliary relay 23 to bias both its own operating current and the operating current of the load control relay 12.

The switch 29 of FIG. 10 consists of the series connection, between P1 and P3, of the photo-sensitive element 11, the operating coil 24 of the auxiliary relay 23, and the operating coil 19 of the load control relay 12. The operating coil 24 of the auxiliary relay 23 is shunted by the current limiting resistors 27 and 28 connected in series with each other. Current limiting resistor 28 is, in turn, shunted by the normally closed contacts 25 of the auxiliary relay 23. The required biasing function occurs when the normally closed contacts 25 drop to the closed position at time T2, FIGS. 4 and 6. The closing of these contacts 25 causes the total resistance of the parallel combination of the current limiting resistors 27 and 28 and the operating coil 24 of the auxiliary relay 23 to be decreased. This will increase the current though the operating coil 19 of the load control relay 12. It will also reduce the resistance of the path shunting the operating coil 24 of the auxiliary relay 23, thus reducing its operating current. The process is reversed at time T4 so that the operation of this switch 29 is the same as that of switch 10 shown in FIG. 4.

Further embodiments and modifications of the invention are contemplated, including element 11 being responsive to other conditions such as heat, pressure or sound.

It is the intention to includes all embodiments and modifications of the invention as are defined by the appended claims within the scope of the invention.

I claim:

1. Condition responsive switch means responsive to at least one of light, temperature, pressure and sound for use in conjunction with a source of energy and a load for automatically connecting and disconnecting the load from the source of energy which switch means is responsive to a specific sequence of condition levels to achieve an inverse off/on ration whereby the load is disconnected from the energy source at a lower condition level to which said switch means is responsive than the condition level at which the load is connected to the energy source.

2. Structure as set forth in claim 1 wherein the condition to which the switch is responsive varies in a predictable sequence.

3. Structure as set forth in claim 2 wherein the source of energy is a source of alternating electrical energy and the load is at least one light.

4. Structure as set forth in claim 3 wherein the switch means includes a light-sensitive element and a load control relay having normally closed contacts connected between the energy source and the load and a coil in series with the light-sensitive element across the energy source.

5. Structure as set forth in claim 4 and further including means in series between the coil of the load control relay and the light-sensitive element for biasing the load control relay to close the load control relay contacts at a first light level in the evening and for opening the load control relay contacts at a different lower light level in the morning.

6. Condition responsive switch means for use in conjunction with a source of alternating electrical energy and a load including at least one light which switch means is responsive to light for automatically connecting and disconnecting the source of energy and the load and which switch means has an inverse off/on ratio whereby the load is disconnected from the energy source at a lower condition level than the condition level at which the load is connected to the energy source, said switch means including a light sensitive element and a load control relay having normally closed contacts connected between the energy source and the load and a coil in series with the light sensitive element across the energy source, means in series between the coil of the load control relay and the light sensitive element for biasing the load control relay to close the load control relay contacts at a first light level in the evening and for opening the load control relay contacts at a different lower light level in the morning wherein the means for biasing the load control relay comprises current limiting resistance means connected in series with the coil of the load control relay between the light sensitive element and the coil of the load control relay and an auxiliary relay having normally closed contacts in parallel with the current limiting resistance means and an auxiliary relay coil connected in series between the light sensitive element and the source of energy and in parallel with the series connected current limiting resistance means.

7. Structure as set forth in claim 6 and further including second current limiting resistance means and normally open contacts of the auxiliary relay connected in parallel with each other and in series between the light sensitive element and the coil of the auxiliary relay.

8. Structure as set forth in claim 6 and further including second current limiting resistance means in series between the light-sensitive element and the parallel normally closed contacts of the auxiliary relay and first mentioned current limiting resistance.

9. In combination a source of alternating electrical energy, a lighting load adapted to be connected across the source of electrical energy and light-sensitive switch means connected between the energy source and lighting load for automatically connecting the load to the source of alternating electrical energy at one light level in the evening and for automatically disconnecting the source of electrical energy from the load at a lower light level in the morning which light sensitive switch means includes a load control relay having a set of normally closed contacts in series between the source of electrical energy and load operable on being closed to connect the source of electrical energy to the load and a coil, a light-sensitive element, a current limiting resistor and the coil of the load control relay connected in series across the source of electrical energy, an auxiliary relay including normally closed contacts in parallel with the current limiting resistor and an auxiliary relay coil connected in parallel with the current limiting resistor and in series between the light-sensitive element and the source of electrical energy.

10. Structure as set forth in claim 9 and further including a second current limiting resistor and a pair of normally open auxiliary relay contacts connected in parallel with each other and in series between the light-sensitive element and the auxiliary relay coil and wherein the current limiting resistors are variable.

11. Structure as set forth in claim 9 and further including a second current limiting resistor in series between the light-sensitive element and the parallel, normally closed contacts of the auxiliary relay and first mentioned current limiting resistor.

12. A method of controlling a lighting load on a source of electrical energy comprising automatically connecting the source of electrical energy to the lighting load at one light level in the evening and automatically disconnecting the source of electrical energy from the lighting load at a lower light level in the morning including the steps of recognizing and reacting to an intervening light level which is lower than both the light level at which the load is connected to the source in the evening and the light level at which the load is disconnected from the source in the morning.

13. The method as set forth in claim 12 wherein the source of electrical energy is connected to and disconnected from the lighting load by controlling biasing of a load control relay and an auxiliary relay to control current therethrough and resulting relay contact pull-in and drop-out times.

14. A method of controlling a lighting load on a source of electrical energy comprising automatically connecting the source of electrical energy to the lighting load at one light level in the evening and automatically disconnecting the source of electrical energy from the lighting load at a lower light level in the morning including the step of connecting the source of electrical energy to and disconnecting the source of electrical energy from the lighting load by controlling biasing of a load control relay and an auxiliary relay to control current therethrough and resulting relay contact pull in and drop out times and the steps of applying bias to the load control relay in the evening after it has dropped out and not applying bias to the auxiliary relay until after the load control relay has dropped out.

15. The method as set forth in claim 14 wherein the auxiliary relay drops out in the evening after the load control relay drops out including taking the bias off the load control relay and applying bias to the auxiliary relay on drop-out of the auxiliary relay.

16. The method as set forth in claim 15 and further including initially limiting the current through the load control relay on application of bias thereto to a value below pull-in current value of the load control relay.

17. The method as set forth in claim 16 and further including applying bias to the auxiliary relay in the morning until after pull-in of the load control relay and not applying bias to the load control relay in the morning until after pull-in of the load control relay.

18. The method as set forth in claim 17 and further including the step of applying bias to the load control relay after pull-in of the auxiliary relay and removing bias from the auxiliary relay after pull-in of the auxiliary relay.

19. The method as set forth in claim 18 and further including initially maintaining operating current through the load control relay to a value above the drop-out current value of the load control relay after pull-in of the auxiliary relay.

* * * * *